US006651740B2

(12) United States Patent
Kobylinski et al.

(10) Patent No.: US 6,651,740 B2
(45) Date of Patent: Nov. 25, 2003

(54) SYSTEM FOR USE IN A SUBTERRANEAN ENVIRONMENT TO VENT GAS FOR IMPROVED PRODUCTION OF A DESIRED FLUID

(75) Inventors: Lee S. Kobylinski, Bartlesville, OK (US); Woon Y. Lee, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 60 days.

(21) Appl. No.: 09/766,739

(22) Filed: Jan. 22, 2001

(65) Prior Publication Data

US 2002/0096327 A1 Jul. 25, 2002

(51) Int. Cl.[7] ..... E21B 43/38
(52) U.S. Cl. ..... 166/265; 166/105.5
(58) Field of Search ..... 166/265, 263, 166/268, 105, 105.5, 267

(56) References Cited

U.S. PATENT DOCUMENTS

| | | | | |
|---|---|---|---|---|
| 1,674,815 A | | 6/1928 | Barnhart | |
| 3,203,351 A | | 8/1965 | Gillis | |
| 4,275,790 A | | 6/1981 | Abercrombie | |
| 4,526,228 A | | 7/1985 | Wynn | |
| 4,621,689 A | * | 11/1986 | Brookbank, III | 166/106 |
| 4,676,308 A | | 6/1987 | Chow et al. | |
| 5,133,407 A | | 7/1992 | Deines et al. | |
| RE34,111 E | | 10/1992 | Wynn | |
| 5,154,588 A | * | 10/1992 | Freet et al. | 166/105.5 |
| 5,240,073 A | | 8/1993 | Bustamante et al. | |
| 5,309,998 A | * | 5/1994 | Rivas et al. | 166/105.5 |
| 5,431,228 A | | 7/1995 | Weingarten et al. | |
| 5,979,559 A | * | 11/1999 | Kennedy | 166/369 |
| 6,039,116 A | * | 3/2000 | Stevenson et al. | 166/105.5 |
| 6,068,053 A | | 5/2000 | Shaw | |
| 6,189,614 B1 | * | 2/2001 | Brady et al. | 166/265 |
| 6,298,917 B1 | * | 10/2001 | Kobylinski et al. | 166/105 |

* cited by examiner

*Primary Examiner*—David Bagnell
*Assistant Examiner*—Jennifer R. Dougherty
(74) *Attorney, Agent, or Firm*—Van Someren, PC; Jeffrey E. Griffin; Brigitte L. Jeffery

(57) ABSTRACT

A system for separating gas from a produced fluid. The system comprises a bottom intake completion utilized in a subterranean location. The system utilizes a gas handling system that separates a gaseous component from a fluid. The gas is vented to a separate flow path, while the fluid having a lower gas content is produced to a desired location.

36 Claims, 3 Drawing Sheets

SYSTEM FOR USE IN A SUBTERRANEAN ENVIRONMENT TO VENT GAS FOR IMPROVED PRODUCTION OF A DESIRED FLUID

FIELD OF THE INVENTION

The present invention relates generally to the production of fluids, such as petroleum, from a downhole environment, and particularly to a system that facilitates the separation of a gaseous component to enhance production of the desired fluid.

BACKGROUND OF THE INVENTION

A variety of completions are used in the production of certain desired fluids, such as petroleum. Exemplary production completions include electric submersible pumping systems that are deployed in a wellbore to pump fluids that accumulate within the wellbore. A typical submersible pumping system includes components, such as a submersible motor, a motor protector and a pump.

In some wells, substantial gaseous components occur with the petroleum or other desired liquid. In these high gas-to-oil ratio wells, electric submersible pumping systems can suffer difficulties in pumping such fluids, potentially leading to lower production, gas lock and/or cyclic operation.

Some completion systems are amenable to removal of a substantial portion of the gas prior to pumping the remaining liquid. However, other systems are not as readily amenable to removal of the gaseous component. In bottom intake completions, such as bottom intake electric submersible pumping systems, the system intake is at or towards the bottom of the completion. Accordingly, removal of the gas prior to drawing the fluid into the system is difficult.

SUMMARY OF THE INVENTION

The present invention features a system and method for facilitating the production of desired fluids from a subterranean location. The system utilizes a completion, such as a bottom intake electric submersible pumping system, to produce a fluid, such as petroleum, from a subterranean location, e.g. from a location within a wellbore. The system and method utilize a gas venting configuration that allows for the removal and venting of gaseous components prior to pumping of the desired fluid.

BRIEF DESCRIPTION OF THE DRAWINGS

The invention will hereafter be described with reference to the accompanying drawings, wherein like reference numerals denote like element, and.

DETAILED DESCRIPTION OF EXEMPLARY EMBODIMENTS

Figure 1:
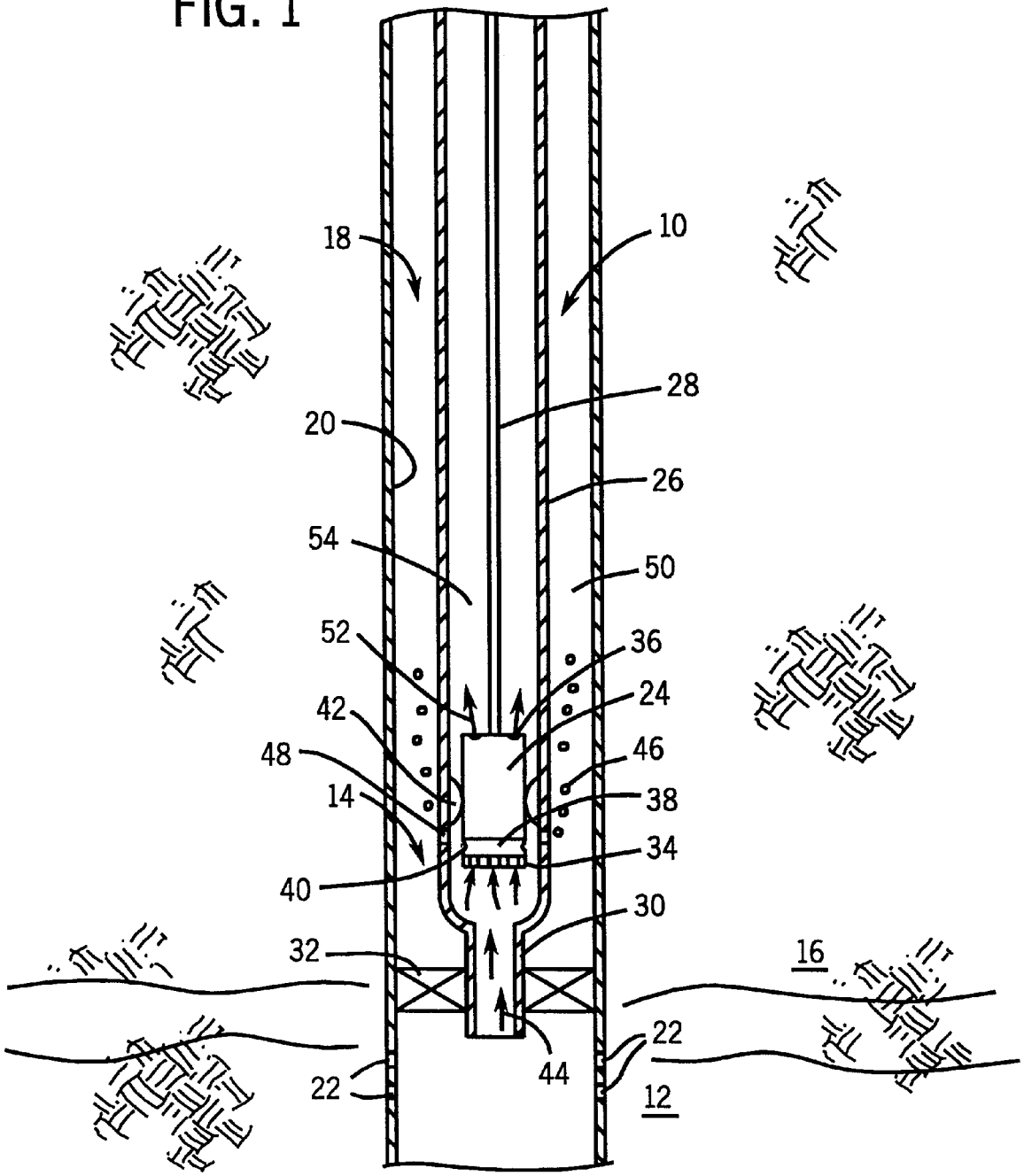
FIG. 1 is a front, elevational view of an exemplary completion for producing a fluid disposed within a wellbore.

Referring generally to FIG. 1, a system 10 for venting a gas during production of a desired fluid from a subterranean location 12 is illustrated according to one embodiment of the present invention. In this exemplary embodiment, system 10 is designed for deployment in a well 14 within a geological formation 16. Geological formation 16 contains one or more desirable production fluids, such as petroleum. In a typical application, a wellbore 18 is drilled and lined with a wellbore casing 20. Wellbore casing 20 may include a plurality of openings 22, e.g. perforations, through which production fluids flow into wellbore 18.

System 10 comprises a completion 24 disposed within an inner wellbore casing 26. Completion 24 typically is deployed into or suspended within inner wellbore casing 26 by a deployment system 28. Exemplary deployment systems include cable or coiled tubing.

The exemplary inner wellbore casing 26 includes a lower portion 30 that extends through a packer 32 deployed intermediate lower portion 30 and the outer wellbore casing 20. (It should be noted that in many applications packer 32 is not necessary.) Fluid entering wellbore 18 via openings 22 is drawn upwardly through lower portion 30 towards completion 24. In this embodiment, completion 24 is a bottom intake completion that draws fluid in through a fluid intake 34, separates a gas component from the fluid and discharges the remaining lower-gas-content fluid through a fluid discharge 36 positioned above fluid intake 34. A gas handling system, such as a gas separator 38, is used to separate the gaseous component and discharge it from completion 24 through a gas outlet 40. A fluid blocking member 42 is located intermediate gas outlet 40 and fluid discharge 36 to limit or prevent the discharged gas from commingling with the lower-gas-content fluid produced through fluid discharge 36. The fluid blocking member 42 may have a variety of forms, including a seating shoe designed to receive completion 24 and positioned to fill the annular space between completion 24 and inner wellbore casing 26. The fluid blocking member also may be positioned at various longitudinal positions along completion 24 or even along a deployment tubing through which fluid is produced.

To facilitate explanation of the process, the relatively higher-gas-content fluid has been labeled with reference numeral 44. The gaseous component discharged through gas outlet 40 has been labeled with reference numeral 46. Following discharge, the gas 46 moves through one or more gas vents 48 formed through inner wellbore casing 26. The gas 46 is thus able to flow outwardly into an annulus 50 formed intermediate inner wellbore casing 26 and outer wellbore casing 20. From that point, the gas rises to a collection location where it may be collected or burned. The remaining lower-gas-content fluid/liquid (labeled with reference numeral 52) is discharged through fluid discharge 36 into an upper interior 54 of inner wellbore casing 26 above fluid blocking member 42. The continual discharge of fluid 52 permits production of the desired fluid upwardly through upper interior 54 to a desired collection point.

Figure 2:
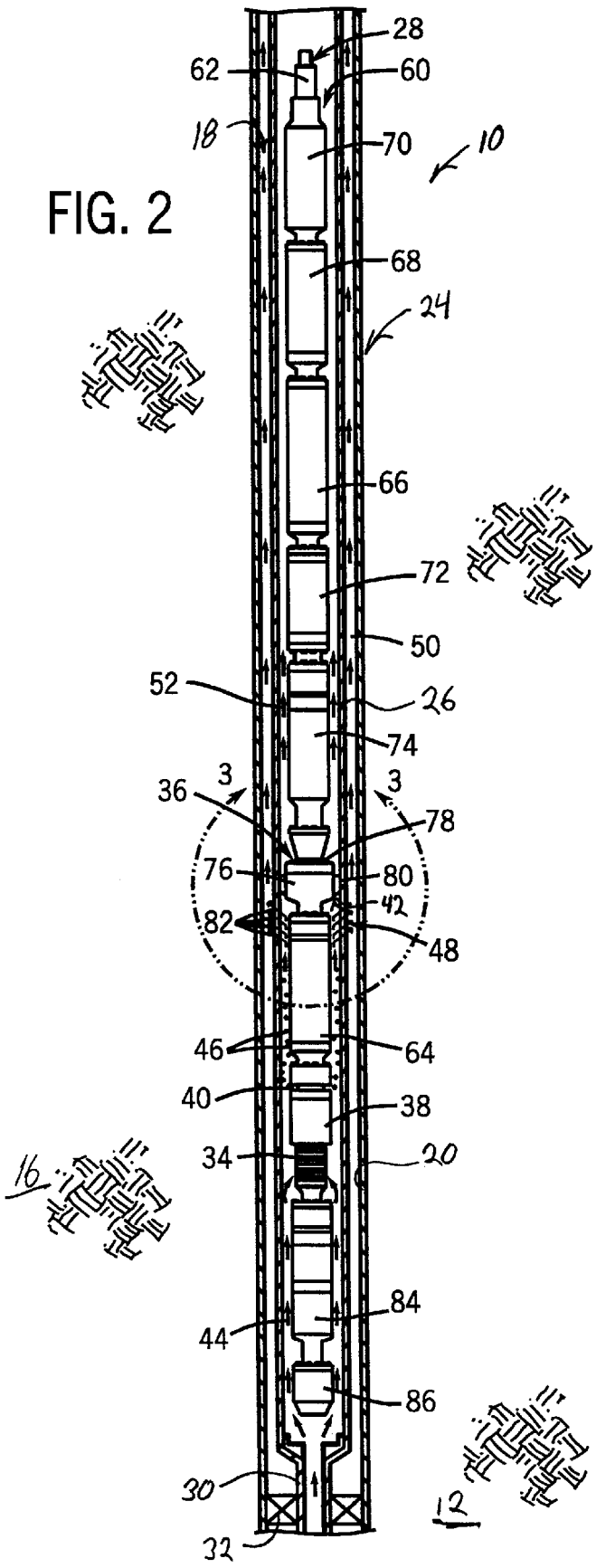
FIG. 2 is a front elevational view of an exemplary completion and system according to one embodiment of the present invention.

Referring generally to FIG. 2, another exemplary embodiment of system 10 is illustrated. In this embodiment, completion 24 comprises a bottom intake electric submersible pumping system (bottom intake ESP system) 60. The bottom intake ESP system 60 may be suspended by, for example, a coiled tubing 62 or a cable, as discussed above. It should also be noted that system 60 is illustrated with exemplary components. However, a variety of components can be added, removed or substituted depending on the specific application.

Exemplary bottom intake ESP system 60 comprises a submersible pump 64 powered by an electric submersible motor 66. In this application, an additional motor 68 is also provided. Motors 68 and 66 are axially coupled intermediate a connector 70 and a universal motor base 72. Connector 70 couples the overall system 60 to deployment system 28, e.g. coiled tubing 62. The inclusion and design of universal motor base 72 depends on whether one or more motors are utilized and the type or types of motors incorporated into overall system 60.

Additionally, a motor protector 74 is deployed between pump 64 and motor 66. In the embodiment illustrated, motor protector 74 is positioned between universal motor base 72 and a discharge head 76 mounted to the upper portion of pump 64.

Discharge head 76 includes fluid discharge 36 in the form of outlet holes 78. The lower-gas-content fluid 52 is discharged by pump 64 into discharge head 76 and out through outlet holes 78 into upper interior 54 of inner wellbore casing 26. Discharge head 76 also is designed for engagement with fluid blocking member 42. In this design, fluid blocking member 42 comprises a seating shoe 80 which is further illustrated in FIG. 3. Other embodiments of fluid blocking member 42 include a packer, such as a remotely actuable packer that may be set at a desired location within inner wellbore casing 26.

Pump 64 may be coupled to gas separator 38 on an end opposite discharge head 76. Gas separator 38 and fluid intake 34 may be separate components, however, in this embodiment gas separator 38 includes fluid intake 34. Thus, the higher-gas-content fluid 44 is drawn into gas separator 38 via intake 34. The gas 46 is separated and discharged through gas outlet 40 into the interior of inner wellbore casing 26 below seating shoe 80. Gas 46 is then vented to annulus 50 via gas vent 48 which is in the form of a plurality of outlet openings 82.

Other potential components for use in bottom intake ESP system 60 include a thrust chamber 84. Thrust chamber 84 is coupled to fluid intake 34/gas separator 38 at an upper end and to a system cap 86 at its lower end.

Figure 3:
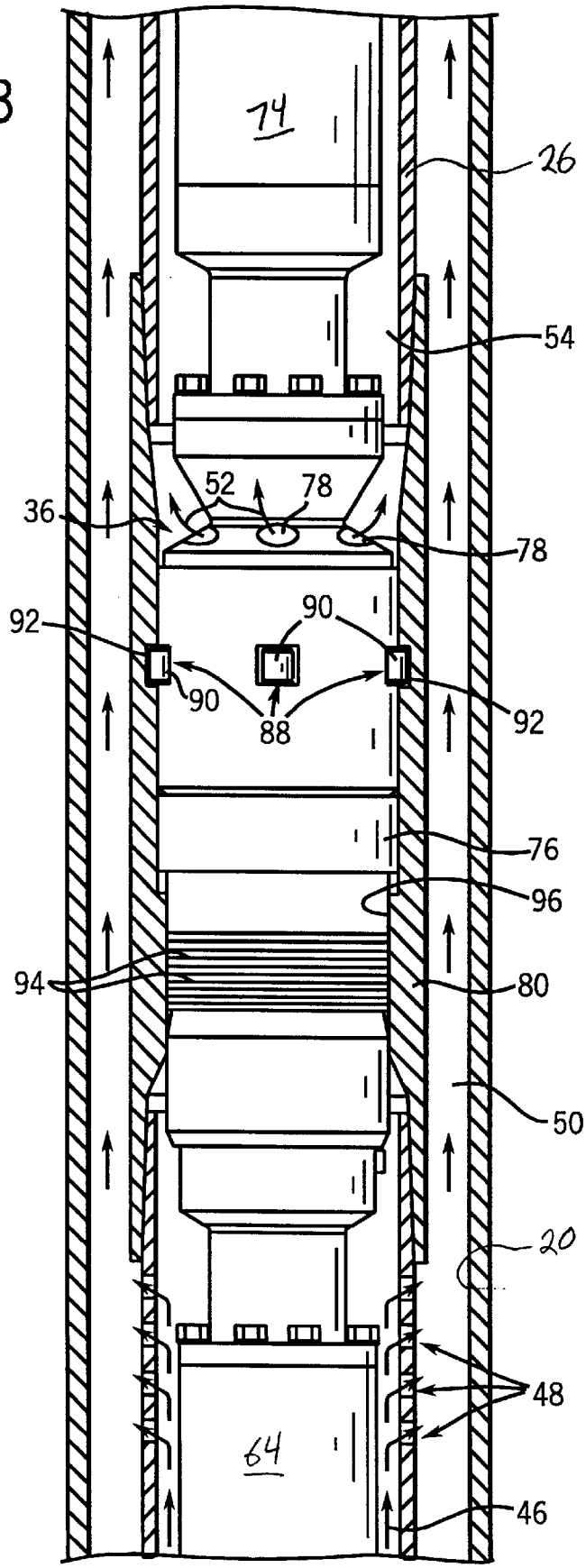
FIG. 3 is a partial cross-sectional view taken generally within line 3—3 of FIG. 2.

An exemplary discharge head 76 is designed for receipt in seating shoe 80, as shown best in FIG. 3. In this embodiment, one or more retention features 88 are used to hold discharge head 76 in an appropriate axial position within seating shoe 80. Retention features 88 comprise a plurality of pins 90 sized for receipt in corresponding recesses 92 formed in the interior surface of seating shoe 80. Pins 90 may be actuated, e.g. by spring actuation or hydraulic actuation, radially outwardly for receipt by the appropriate, corresponding recesses 92.

Additionally, discharge head 76 may comprise one or more seals 94 designed for sealing engagement with a corresponding seal surface 96 formed on the interior surface of seating shoe 80. Seal or seals 94 further help prevent transfer of gas from the region of inner wellbore casing 26 below discharge head 76 to the upper interior 54 of inner wellbore casing 26. Thus, the flow of gas 46 is directed radially outward through gas vent 48 and upwardly through annulus 50. Simultaneously, the lower-gas-content fluid 52 is discharged through outlet holes 78 into upper interior 54, as discussed above.

It will be understood that the foregoing description is of exemplary embodiments of this invention, and that the invention is not limited to the specific forms shown. For example, a variety of other types of production completions, including various arrangements of bottom intake electric submersible pumping systems, can be used in the overall system; a variety of gas handling devices, such as various gas separators, can be incorporated into the system; the system may be used in the production of a variety of fluids; and the discharged fluids can be conducted to various collection points at the surface of the earth or elsewhere. These and other modifications may be made in the design and arrangement of the elements without departing from the scope of the invention as expressed in the appended claims.

What is claimed is:

1. A system for venting a gas during production of a desired fluid from a wellbore, comprising:

an outer wellbore casing;

an inner weilbore casing having a perforation, the inner wellbore casing and the outer wellbore casing forming an annulus therebetween;

a deployment system disposed within the inner wellbore casing;

an electric submersible pumping system suspended within the inner wellbore casing by the deployment system; and a blocking member deployed within the inner wellbore casing at a location above the perforation, wherein the desired fluid is directed through the blocking member and the gas within the inner wellbore casing is vented through the perforation and the annulus.

2. The system as recited in claim 1, wherein the deployment member comprises a cable.

3. The system as recited in claim 1, wherein the deployment member comprises a coiled tubing.

4. The system as recited in claim 1, further comprising a gas separator disposed below the blocking member.

5. The system as recited in claim 1, wherein the blocking member comprises a seating shoe.

6. The system as recited in claim 1, wherein the blocking member comprises a packer.

7. The system as recited in claim 1, wherein the bottom intake production completion comprises a bottom intake electric submersible pumping system.

8. The system as recited in claim 7, wherein the bottom intake electric submersible pumping system has a gas separator disposed below the perforation.

9. The system as recited in claim 8, wherein the blocking member comprises a seating shoe.

10. The system as recited in claim 8, wherein the blocking member comprises a packer.

11. The system as recited in claim 8, further comprising a packer disposed intermediate the inner wellbore casing and the outer wellbore casing.

12. The system as recited in claim 11, wherein the packer is positioned beneath the perforation.

13. A system for venting a gas during production of a desired fluid from a subterranean location, comprising:

a bottom intake electric submersible pumping system having an electric motor, a pump and a pump intake, the electric motor being deployed downstream from the pump;

a wellbore casing disposed about the bottom intake electric submersible pumping system to receive a direct flow of liquid from the bottom intake electric submersible pumping system;

a flow blocking member disposed between the electric submersible pumping system and the wellbore casing; and a gas vent formed through the wellbore casing at a location below the flow blocking member to vent gas from the wellbore casing.

14. The system as recited in claim 13, wherein the bottom intake electric submersible pumping system comprises a gas separator.

15. The system as recited in claim 13, further comprising a gas separation system disposed within the wellbore casing at a location below the flow blocking member.

16. The system as recited in claim 13, further comprising a deployment member to suspend the electric submersible pumping system within the wellbore casing.

17. The system as recited in claim 16, further comprising an outer wellbore casing radially spaced from the wellbore casing to provide a gas flow passage.

18. The system as recited in claim 17, wherein the deployment member comprises a cable.

19. The system as recited in claim 17, wherein the deployment member comprises a coiled tubing.

20. The system as recited in claim 17, wherein the blocking member comprises a seating shoe.

21. The system as recited in claim 17, wherein the blocking member comprises a packer.

22. The system as recited in claim 17, further comprising a packer disposed intermediate the inner wellbore casing and the outer wellbore casing.

23. A system for venting a gas during production of a desired fluid from a wellbore, comprising:

an outer wellbore casing;

an inner wellbore casing positioned to form a flowpath between the inner and the outer wellbore casing, the inner wellbore casing having a vent;

a deployment system disposed within the inner wellbore casing; and a bottom intake pumping system having a pump powered by a submersible motor disposed above the pump, the bottom intake pumping system being suspended within the inner wellbore casing to produce a desired liquid, wherein a gas is separated from the desired liquid and vented to the flowpath via the vent.

24. The system as recited in claim 23, wherein the bottom intake pumping system comprises a bottom intake electric submersible pumping system.

25. The system as recited in claim 24, wherein the bottom intake electric submersible pumping system comprises a gas separator.

26. The system as recited in claim 25, wherein the bottom intake electric submersible pumping system comprises a discharge head having an outlet through which a fluid is discharged.

27. The system as recited in claim 26, further comprising a flow blocking member deployed intermediate the discharge head and the inner wellbore casing.

28. The system as recited in claim 27, wherein the flow blocking member comprises a seating shoe.

29. The system as recited in claim 27, wherein the blocking member comprises a packer.

30. The system as recited in claim 28, wherein the bottom intake electric submersible pumping system is suspended by a coiled tubing.

31. A method for producing a fluid from a wellbore, comprising:

deploying a bottom intake electric submersible pumping system having a submersible motor and a submersible pump powered by the submersible motor, the submersible motor being downstream of the submersible pump within a wellbore casing;

separating a gas from a fluid within the wellbore casing;

blocking upward flow of the gas between the wellbore casing and the bottom intake electric submersible pumping system; and venting the gas to the exterior of the wellbore casing below the location at which upward flow of the gas within the wellbore casing is blocked.

32. The method as recited in claim 31, wherein venting comprises directing the gas upwardly through an annulus formed around the wellbore casing.

33. The method as recited in claim 31, further comprising locating an outer wellbore casing to define the radially outer limit of the annulus.

34. The method as recited in claim 33, further comprising suspending the bottom intake electric submersible pumping system from a cable.

35. The method as recited in claim 33, further comprising suspending the bottom intake electric submersible pumping system from a coiled tubing.

36. The method as recited in claim 31, further comprising producing a liquid into the wellbore casing above the location at which upward flow of the gas within the wellbore casing is blocked.

* * * * *

UNITED STATES PATENT AND TRADEMARK OFFICE

CERTIFICATE OF CORRECTION

PATENT NO. : 6,651,740 B2
DATED : November 25, 2003
INVENTOR(S) : Lee S. Kobylinski et al.

It is certified that error appears in the above-identified patent and that said Letters Patent is hereby corrected as shown below:

Column 4,
Line 11, delete “weilbore” and insert -- wellbore --.

Signed and Sealed this

Twenty-fourth Day of February, 2004

JON W. DUDAS
*Acting Director of the United States Patent and Trademark Office*